United States Patent [19]

Okuda

[11] Patent Number: 4,617,442

[45] Date of Patent: Oct. 14, 1986

[54] INDUCTION HEATING APPARATUS WITH CONTROLLED SWITCHING DEVICE FOR IMPROVED EFFICIENCY

[75] Inventor: Tadao Okuda, Shiga, Japan

[73] Assignee: Sanyo Electric Co., Ltd., Osaka, Japan

[21] Appl. No.: 672,386

[22] Filed: Nov. 16, 1984

[30] Foreign Application Priority Data

Dec. 14, 1983 [JP] Japan ..... 58-236582

[51] Int. Cl.[4] ..... H05B 6/06

[52] U.S. Cl. ..... 219/10.77; 219/10.49 R; 363/97; 363/80; 323/246; 361/83

[58] Field of Search ..... 219/10.77, 10.75, 10.49 R; 363/95, 97, 98, 131, 80; 361/83; 323/246, 242, 243

[56] References Cited

U.S. PATENT DOCUMENTS 4,115,676 9/1978 Higuchi et al. ..... 219/10.77 X
4,179,727 12/1979 Muto et al. ..... 363/96 X
4,277,667 7/1981 Kiuchi ..... 219/10.49 X
4,351,020 9/1982 Letl et al. ..... 363/97 X
4,390,769 6/1983 Steigerwald ..... 219/10.77
4,461,990 7/1984 Bloomer ..... 323/246 X

*Primary Examiner*—Philip H. Leung
*Attorney, Agent, or Firm*—Darby & Darby

[57] ABSTRACT

An induction heating apparatus includes an inverter (5) which is driven by a DC power supply (3), and the inverter (5) includes a heating coil (9) and a switching transistor (11) which is connected thereto in series. The switching transistor (11) is turned on or off by a control circuit (35) to control a current flowing through the heating coil (9). The control circuit (35) takes a collector voltage of this switching transistor (11) from the point where the heating coil (9) and the switching transistor (11) are connected in series through a terminal (39). An integrated voltage of this collector voltage is generated in the control circuit (35), and the collector voltage is compared with the integrated voltage. When the former becomes lower than the latter, after a certain delay time, a switching signal is outputted from the control circuit (35), and the switching transistor (11) is turned on. Such a delay time is preferably varied in response to the magnitude of the collector voltage.

6 Claims, 14 Drawing Figures

INDUCTION HEATING APPARATUS WITH CONTROLLED SWITCHING DEVICE FOR IMPROVED EFFICIENCY

BACKGROUND OF THE INVENTION

1. Field of the Invention

The present invention relates to an induction heating apparatus. More specifically, the present invention relates to an induction heating apparatus wherein a heating coil and a switching device connected thereto in series are included and a current flowing through the heating coil, that is, a power is controlled by turning on or off this switching device.

2. Description of the Prior Art

FIG. 1 is a circuit diagram showing one example of the conventional induction heating apparatus interesting for the present invention. This prior art is disclosed in the Japanese Patent Publication No. 36473/1983 published on Aug. 9, 1983.

An AC voltage from a low-frequency AC power supply 1 is converted into a DC voltage by rectifying circuit 3, and the DC voltage from this rectifying circuit 3 is applied to an inverter 5. The inverter 5 includes a capacitor 7 connected across input terminals of the DC voltage from the rectifying circuit 3, and this capacitor 7 acts as a moothing capacitor. A series connection of a heating coil 9 and a switching transistor 11 is connected with a smoothing capacitor 7. A resonance capacitor 13 and a fly-wheel diode 15 are connected between the collector and the emitter of the switching transistor 11. The resonance capacitor 13 constitutes and LC resonance circuit in cooperation with the heating coil 9.

To control turning on or off of the switching transistor 11, a control circuit 17 is provided, and five terminals 19*a*, 19*b*, 21*a*, 21*b* and 23 are connected to the control circuit 17. The DC voltage from the rectifying circuit 3 is taken into the control circuit 17 through the terminals 19*a* and 19*b*. On the other hand, a voltage of the point where the heating coil 9 and the switching transistor 11 are connected in series, that is, the collector voltage of the switching transistor 11 is taken into the control circuit 17 through the terminal 23. In the control circuit 17, the two voltages thus taken are compared with each other, and based on this comparison, a switching pulse for turning on or off the switching transistor 11 is outputted to the terminals 21*a* and 21*b*. More specifically, when the collector voltage from the terminal 23 becomes lower than the DC voltage from the terminal 19*a*, after a certain time set by a delay circuit (not illustrated), the switching transistor 11 is turned on.

In accordance with this prior art, timing of turning on of the switching transistor 11 is controlled based on the comparison between two voltages, and therefore an effect can be expected that a stable oscillation can be sustained even when a comparatively large variation in load takes place.

However, this prior art cited above still leaves the following problem to be solved. More specifically, in this prior art, the base current of the switching transistor is controlled based on the comparison of the DC power supply voltage with the collector voltage of the switching transistor, and therefore particularly when the oscillation frequency of the resonant circuit becomes high, switching loss of the switching transistor becomes large. To be further detailed, when the oscillation frequency is raised, fall of the collector voltage of the switching transistor becomes slow, while the magnitude of the DC voltage is not varied, and accordingly the timing when the collector voltage becomes smaller than the DC voltages becomes earlier. In other words, when the frequency is higher, the timing of turning on of the switching transistor becomes earlier compared with the case where the frequency is lower. At such an earlier timing, the collector voltage of the switching transistor does not fall enough, and accordingly the switching transistor is turned on in a state where the collector voltage of the switching transistor is comparatively large. Consequently, an inrush current which flows at an instant of turning on of the switching transistor becomes large, and such an inrush current produces a large switching loss. Thus, in the prior art as cited above, particularly when the oscillation frequency is high, the switching loss becomes large and thereby a reduction in efficiency becomes a problem.

SUMMARY OF THE INVENTION

Therefore, the principal object of the present invention is to provided an induction heating apparatus which can reduce the switching loss within a wider range of frequencies.

In the present invention, in order to achieve the above-mentioned object, the voltage across the terminals of the switching device is compared with the integrated voltage thereof and turning on or off of the switching device is controlled based on this comparison.

In accordance with the present invention, if the voltage across the terminals of the switching device comes small, the integrated voltage thereof also becomes small in response to it, in other words, two voltages to be compared are varied in the same aspect in response to some condition, for example, oscillation frequency or the voltage across the terminals of the switching device, and therefore, for example, even in the case where the oscillation frequency of the inverter becomes high, the switching device can be turned on after the voltage across the terminals of the switching device has become sufficiently small. Consequently, the inrush current flowing at a turning on of the switching device can be minimized, and accordingly the switching loss can be minimized to improve the efficiency. Thus, in accordance with the present invention, an induction heating apparatus can be obtained which can stably control the output power thereof within a wider range of oscillation frequencies of the inverter in comparison with that of the prior art as cited previously.

Particularly, in the case where a low-frequency AC power supply is employed and the voltage thereof is high, the switching loss becomes larger by employing the cited prior art. For example, assuming that the peak value of the collector voltage of the switching transistor is 700V when the voltage of the low-frequency AC power supply is 100V and the peak value thereof is 141V, the peak value of the collector voltage becomes as high as 1400V in the case where the voltage of the low-frequency AC power supply is 200V and the peak value thereof becomes 282V. When the voltage of the low-frequency AC power supply becomes larger such as 220V, 240 V---, the peak value of the collector voltage becomes even larger. At present, no switching transistor which can withstand such a large voltage has ever realized, and accordingly, the high peak voltage thereof has to be reduced down to, for example, about 1200V.

Consequently, the relative ratio of the voltage of the low-frequency AC power supply to the collector voltage is varied. On the other hand, the attenuation factor of oscillation voltage is constant independent of the peak value thereof. Accordingly, in according the prior art, the larger the voltage of the low-frequency AC power supply becomes, the earlier the timing when the oscillation voltage, namely, the collector voltage falls below it becomes, and thereby the inrush current flowing through the switching transistor becomes still larger. On the contrary, in accordance with the present invention, because the two voltages to be compared are picked up from the same point, the two voltages to be compared can be reduced likewise on the same condition, and even if a low-frequency AC power supply is employed, the switching loss can be minimized independent of the voltage thereof.

Furthermore, in the prior art as cited previously, in the case where the AC voltage is superposed on the DC voltage and particularly the output power is small, oscillation is stopped affected by the heating coil. To be further detailed, in the prior art, because the heating coil lies between the terminal wherein the DC voltage is to be picked up and the terminal wherefrom the collector voltage of the switching transistor is to be picked up, the collector voltage is varied in response to the variation of the AC voltage with a delay time due to the heating coil. For this reason, an optimum loading condition is set in view of such a time deviation; however, in the case where the inductance of the heating coil is varied due to a change in load, namely, the material of the cooking pan or the like, and particularly in the case where the oscillation frequency is high, that is, the output power is small, the phase between the valley point of the AC voltage and the valley point of the collector voltage is varied larger than designed in advance, and at that point the oscillation of the inverter is stopped. In other words, in the prior art, in the case of the load deviating from ideal loading conditions, a variable output power range capable of sustaining a stable oscillation sometimes became small. On the contrary, in accordance with the present invention, because the voltage across the terminals of the switching device and the integrated voltage thereof are picked up from the same point, there is no effect by the heating coil and accordingly there is no phase deviation between the two voltages to be compared. Consequently, in accordance with the present invention, even when the AC voltage is superposed on the DC voltage, a stable control or adjustment can be made down to a smaller output power.

In accordance with a preferable embodiment, the switching device is turned on with a certain delay time after the voltage across the terminals of the switching device becomes lower than the integrated voltage thereof. According to the present embodiment, the switching device can be turned on in a state where the voltage across the terminals is small closely to zero, and thereby the switching loss can be further reduced.

In accordance with another preferable embodiment, the delay time as mentioned above is varied in response to the magnitude of the voltage across the terminals of the switching device. To be further detailed, the delay time is shortened when the voltage across the terminals is large, and the delay time is lengthened when the voltage across the terminals is small. On the other hand, the trailing end of the voltage across the terminals of the switching device has a sharp fall when the magnitude thereof is large and the fall becomes slow when the magnitude is small. Accordingly, by varying the delay time in response to the magnitude of the voltage across the terminals in accordance with this preferable embodiment, the switching device can be turned on reliably in the vicinity of zero of the voltage across the terminals, and therefore the switching loss can be made still smaller.

These objectives and other objects, features, aspects and advantages of the present invention will become more apparent from the following detailed description of the embodiments of the present invention when taken in conjunction with accompanying drawings.

DESCRIPTION OF THE PREFERRED EMBODIMENTS

Figure 1:
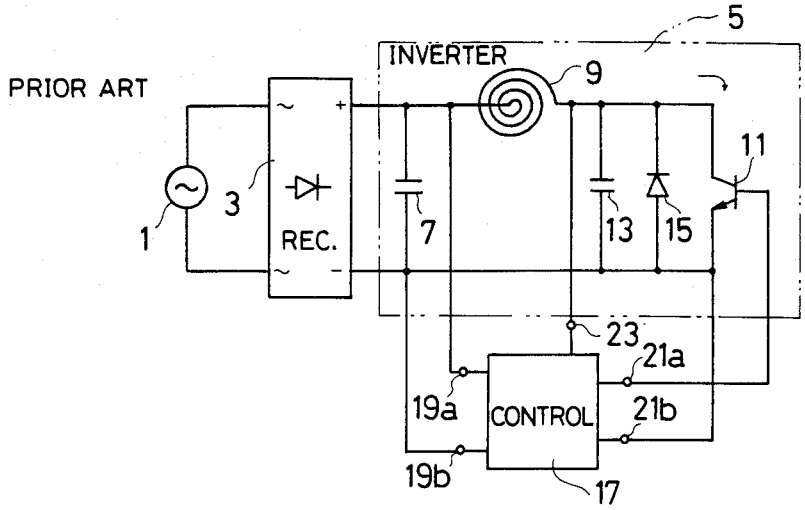
FIG. 1 is a circuit diagram showing one example of a conventional induction heating apparatus interesting for the present invention.
Figure 2:
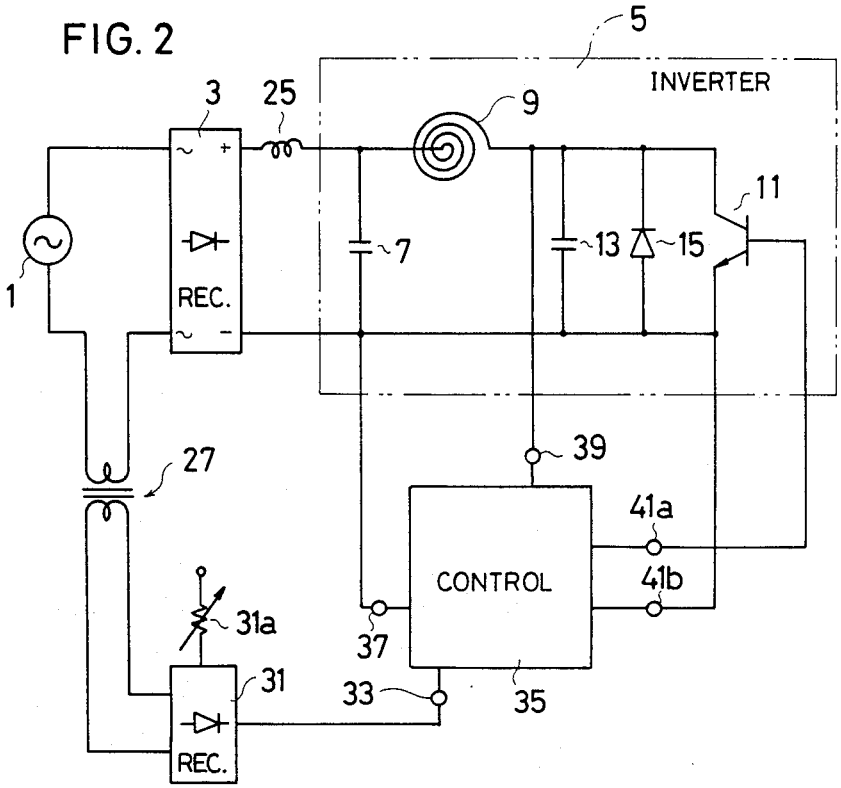
FIG. 2 is a circuit diagram showing one embodiment in accordance with the present invention.

FIG. 2 is a circuit diagram shown one embodiment in accordance with the present invention. In this FIG. 2, the same reference symbols are given to the same as similar to the elements in FIG. 1, and detailed description thereof will be omitted.

A choke coil 25 is connected between the rectifying circuit 3 and the smoothing capacitor 7 included in the inverter 5. A current transformer 27 is connected between the low-frequency AC power supply 1 and the rectifying circuit 3, and an output voltage from this current transformer 27 is converted into a DC voltage by another rectifying circuit 31, being given to a terminal 33 of a control circuit 35. A voltage varying means 31*a* including, for example, a variable resistor or the like is provided, being associated with this rectifying circuit 31 so that the magnitude of the output DC voltage can be adjusted appropriately.

The control circuit 35 further includes terminals 37, 39, 41*a* and 41*b*. The terminal 37 is connected to the ground level or a reference potential. The terminal 39 is connected to the point where the heating coil 9 and the switching device 11 are connected in series, and through this terminal 39 the voltage across the terminals of the switching device 11 is taken in. A switching signal for turning on or off the switching device 11 is outputted to the terminals 41*a* and 41*b* likewise the terminals 21*a* and 21*b* in FIG. 1.

To give an outline, the control circuit 35 takes in the voltage across the terminals of the switching device 11 through the terminals 39 and 37 and also produces the integrated voltage (average voltage) of this voltage across the terminals, compares these two voltages with each other, and outputs a switching pulse to the terminals 41*a* and 41*b* with a certain delay time after the former has become lower than the latter. Responsively, the switching device 11 is turned on.

For the switching device 11, in addition to the bipolar transistor, the metal-oxide semiconductor field-effect transistor, static induction transistor, gate turn off thyristor or the like can be utilized, and hereinafter description is made on the case where the NPN transistor is utilized for the switching device 11.

Figure 3:
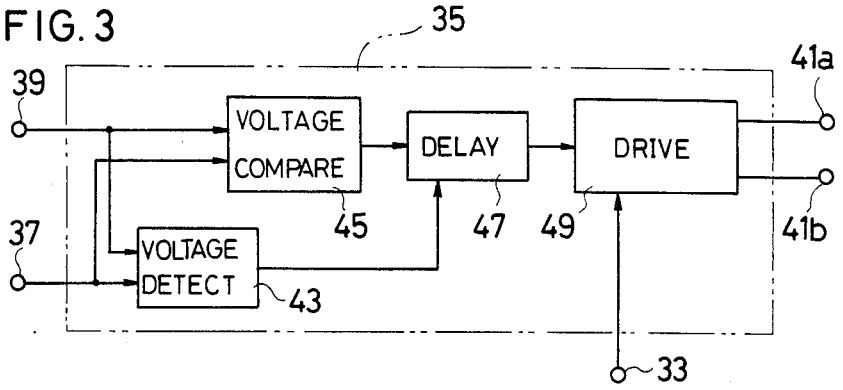
FIG. 3 is a block diagram making detailed explanation on a control circuit of FIG. 2 embodiment.

FIG. 3 shows a configuration of the control circuit 35. Both of the terminals 37 and 39 of the control circuit 35 are connected to a voltage detecting circuit 43 and a voltage comparing circuit 45. in the voltage detecting circuit 43, the magnitude of the collector voltage, namely, the voltage between the collector and the emitter of the switching transistor 11 which is given from the terminal 39 is detected, and the output of this voltage detecting circuit 43 is given to a delay circuit 47. The voltage comparing circuit 45 compares the collector voltage (voltage between the collector and emitter) of the switching transistor 11 which is given from the terminal 39 with the integrated voltage thereof which is produced by an integration circuit (FIG. 4).

Figure 4:
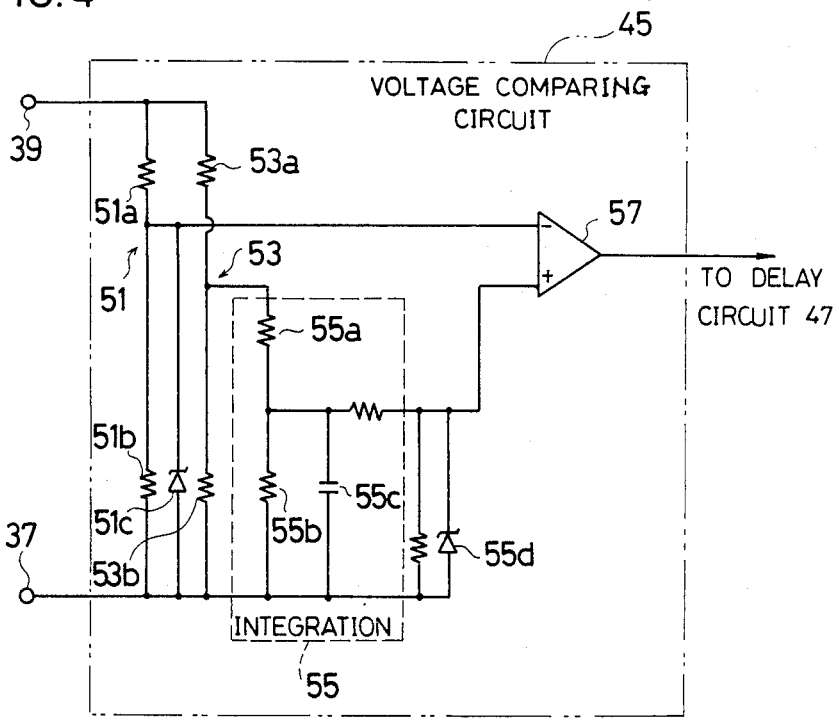
FIG. 4 is a circuit diagram showing one example of a voltage comparing circuit as illustrated in FIG. 3.

To be further detailed, the voltage comparing circuit 45, as shown in FIG. 4, includes two voltage dividing circuits 51 and 53 which receive the collector voltage of the switching transistor 11 from the terminal 39. The voltage dividing circuit 51 includes resistors 51*a* and 51*b* connected in series between the terminal 39 and the terminal 37, and a zener diode 51*c* is connected to the resistor 51*b* in parallel. This zener diode 51*c* is for preventing the output voltage of the voltage dividing circuit 51 from becoming larger than a certain value. Another voltage dividing circuit 53 includes resistors 53*a* and 53*b* which are connected in series between the terminal 39 and the terminal 37, and the output of this voltage dividing circuit 53 is given to an integration circuit 55.

The integration circuit 55 includes a resistor 55*a* and a resistor 55*b* connected thereto in series for further dividing the output voltage from the voltage dividing circuit 53. Then, a capacitor 55*c* is connected in parallel with the resistor 55*b*. Furthermore, a zener diode 55*d* is connected to the output of the integration circuit 55. This zener diode 55*d* is, in normal state, a protective device for making sure that the integrated voltage is smaller than the collector voltage.

The output of the voltage dividing circuit 51 is connected to a (−) terminal of a comparator 57, and the output of the integration circuit 55 is connected to a (+) terminal of the comparator 57. Thus, in the voltage comparing circuit 45, the collector voltage of the transistor 11 obtained from the terminal 39 is compared with the integrated voltage (average voltage) of the collector voltage produced by the integration circuit 55. Then, the comparator 57 outputs a signal of high level when the collector voltage given to the (−) terminal becomes smaller than the integrated voltage given to the (+) terminal. When the voltage of the (−) terminal is larger than the voltage of the (+) terminal, low level (zero volt) is outputted from the comparator 57. Then, the output from this comparator 57, namely, the voltage comparing circuit 45 is given to the delay circuit 47.

Figure 5:
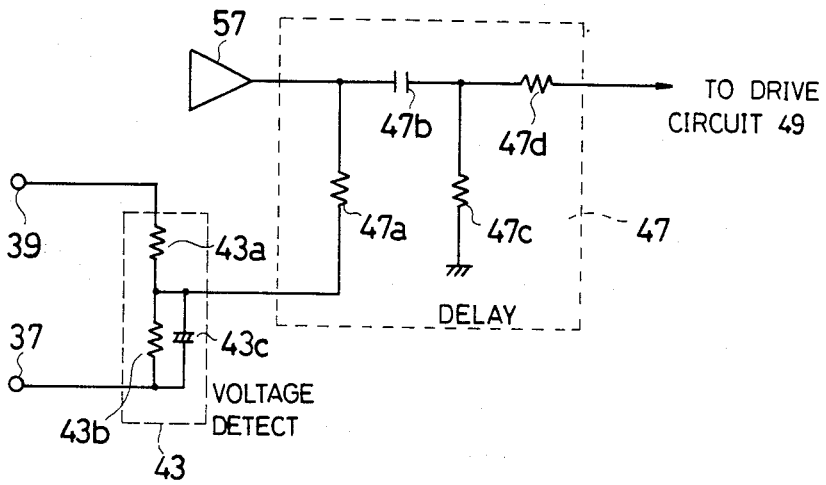
FIG. 5 is a circuit diagram showing one example of a delay circuit as illustrated in FIG. 3.

FIG. 5 shows the detailed delay circuit 47 in detail. In this FIG. 5, the delay circuit 47 includes a resistor 47*a* which receives the out voltage from the voltage detecting circuit 43, and one end of this resistor 47*a* is connected to the output of the comparator 57 of the comparing circuit (FIG. 4), and the output of this comparator 57 is connected to one terminal of a capacitor 47*b*. The other terminal of this capacitor 47*b* is grounded through a resistor 47*c*, and also connected to a % drive circuit 49 through a resistor 47*d*.

The voltage detecting circuit 43, as shown in FIG. 4, includes resistors 43*a* and 43*b* which are connected in series between the terminal 39 and the terminal 37 and also constitute a comparing voltage dividing circuit, and a capacitor 43*c* is connected in parallel with the resistor 43*b*. Accordingly, a voltage of the magnitude responding to the magnitude of the collector voltage of the switching transistor 11 from the terminal 39 is obtained at the output of the voltage detecting circuit 43. Then, as described above, the output voltage thereof is given to the output of the comparator 57 included in the voltage comparator circuit, namely, the capacitor 47*b* through the resistor 47*a*.

Figure 6:
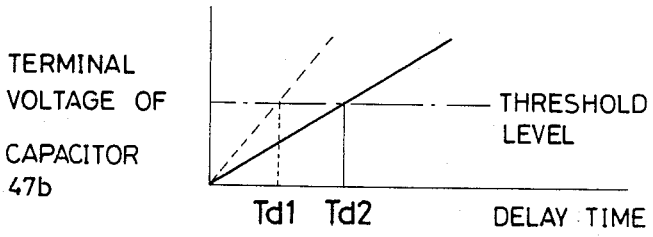
FIG. 6 is a graph for explaining operation of the circuit in FIG. 5.

The comparator 57 is of an open collector type, and the output thereof is connected to the output of the voltage detecting circuit 43 through the resistor 47*a*. Accordingly, the output voltage of this comparator 57 is varied in response to the magnitude of the output voltage of the voltage detecting circuit 43, that is, the magnitude of the collector voltage of the switching transistor 11 (FIG. 2). When the collector voltage is large, the level of the output voltage of the comparator 57 also becomes large, and accordingly, the voltage of the differential capacitor 47*b* also rises quickly. Accordingly, the time during which the differential voltage reaches a certain threshold value is short. In reverse, when the collector voltage is relatively small, the time during which the differential voltage of the differential capacitor 47 reaches that threshold value is long. The difference in the time during which this threshold value is reached is given as a difference in delay time in this delay circuit 47. A delay time Td1 of this delay circuit 47 becomes Td1 in FIG. 6 when the collector voltage from the terminal 39 is large, and becomes Td2 (Td2>Td1) in FIG. 6 when the collector voltage is small. That is, the delay time of the delay circuit 47 is varied depending upon the magnitude of the collector voltage of the switching transistor 11 obtained from the terminal 39.

Figure 7:
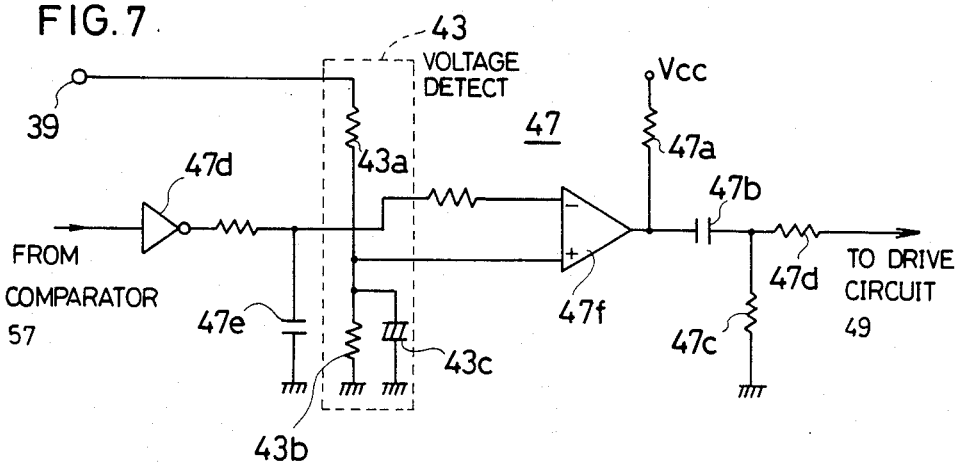
FIG. 7 is a circuit diagram showing another example of the delay circuit.

The delay circuit 47 may be constituted as shown in FIG. 7. In this example as shown in FIG. 7, the collector voltage from the terminal 39 is given to the voltage detecting circuit 43 likewise the one as shown in FIG. 5. On the other hand, the output from the comparator 57 included in the voltage comparing circuit 45 is inverted by the inverter 47*d*, being given to an integration capacitor 47*e*. Then, the voltage of this capacitor 47*e* is given to the (−) terminal of a comparator 47*f*, and the output voltage of the voltage detecting circuit 43 is given to the (+) terminal of this comparator 47*f*. This comparator 47*f* is constituted as an open collector type likewise the comparator 57 as mentioned previously, and the output thereof is connected to a voltage Vcc through the resistor 47*a*. The resistor 47*a*, the capacitor 47*b*, the resistor 47*c* and the resistor 47*d* constitute a differential circuit likewise the circuit in FIG. 5. Accoringly, a differential pulse is led to the output of this delay circuit 47.

Figure 8:
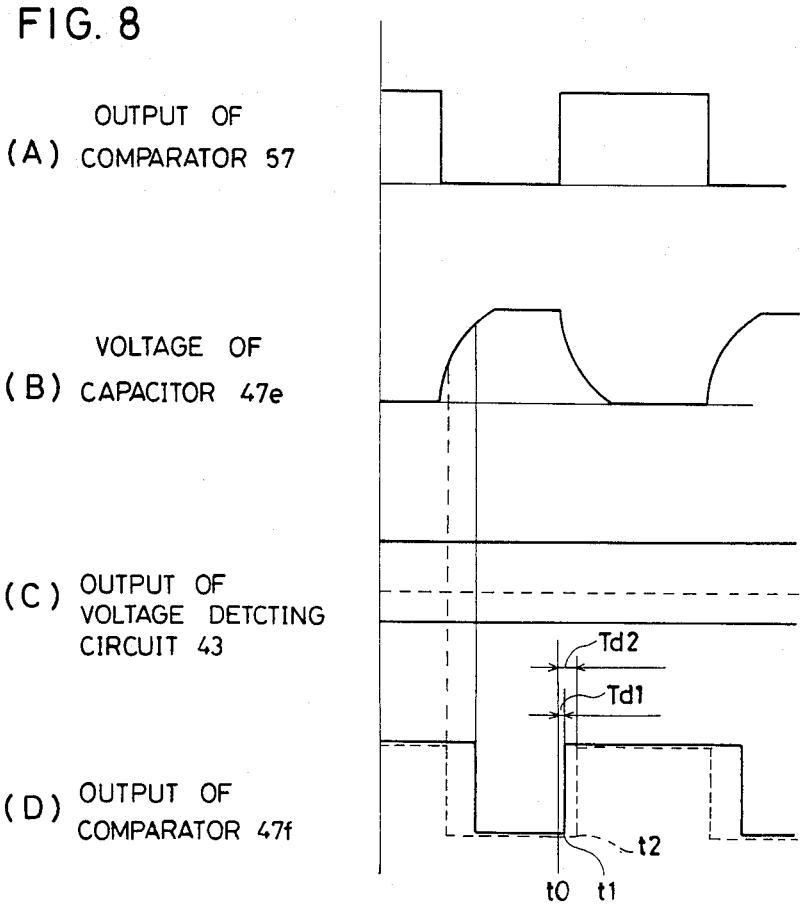
FIGS. 8(A–D) are graphs of waveforms at each portion for explaining operation of the circuit in FIG. 7.

In a configuration as shown in FIG. 7, the output from the voltage comparator 57 is given as shown in FIG. 8 (A). Responsively, the voltage of the integration capacitor 47*e* becomes as shown in FIG. 8 (B). FIG. 8 (C) shows the output voltage of the voltage detecting circuit 43, and FIG. 8 (D) shows the output of the voltage comparator 47*f*. When the collector voltage of the switching transistor 11, namely, the voltage from the terminal 39 is relatively large as shown by a solid line in FIG. 8 (C), the output of the comparator 47*f* rises at a timing t1 as shown in FIG. 8 (D). On the contrary, when the output of the voltage detecting circuit 43 is relatively small as shown by a dotted line in FIG. 8 (C), the voltage of the integration capacitor 47*e* reaches the threshold valve relatively later, and accordingly the output of the voltage comparator 47*f* rises at a timing t2 in FIG. 8 (D). Accordingly when the output voltage of the voltage detecting circuit 43, namely, the collector voltage is relatively large, a time Td1 between t0 and t1 in FIG. 8 (D) becomes a delay time, and when the collector voltage is relatively small, a time Td2 between t0 and t2 in FIG. 8 (D) becomes a delay time.

In FIG. 2 embodiment, for example, when the output power of the induction heating apparatus is maximum, the collector voltage becomes 700 Vp−p, and when the output power is minimum, the collector voltage becomes 300 Vp−p. Then, the delay time in the delay circuit 47 as described above can be varied from 1 μsec to 3 μsec in response to such a change in the collector voltage.

Figure 9:
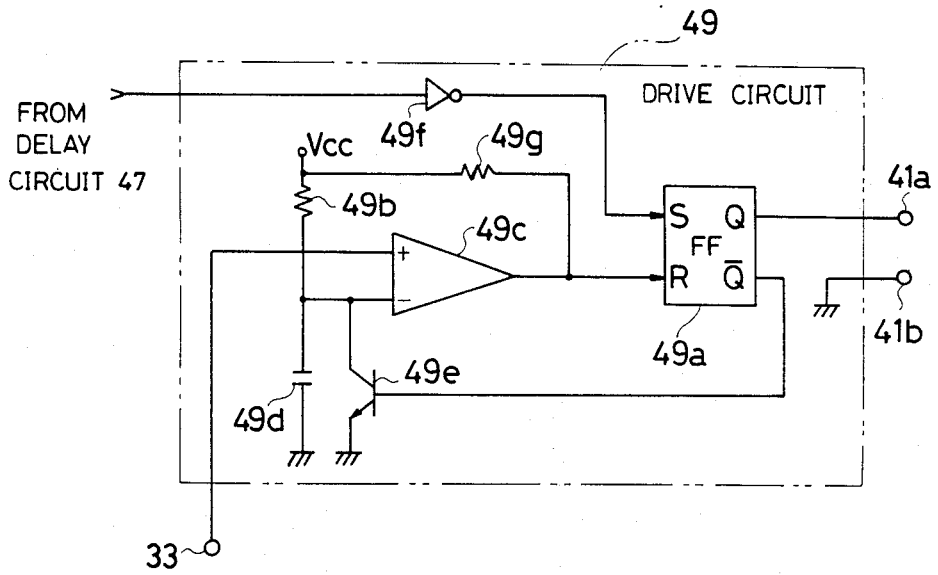
FIG. 9 is a circuit diagram showing one example of a drive circuit as illustrated in FIG. 3.

FIG. 9 is a circuit diagram showing one example of the drive circuit as illustrated in FIG. 3. The drive circuit 49 includes a R-S flip-flop 49*a*, and a differential pulse from the delay circuit 47 is given to a set input (S) thereof through an inverter 49*f*. A resistor 49*b* and a capacitor 49*d* are connected in series between a voltage Vcc and a reference voltage, and the terminal voltage of the capacitor 49*d* is given to the (−) terminal of a comparator 49*c*. Then, the DC voltage from the rectifying circuit 31 (FIG. 1) is given to the (+) terminal of the comparator 49*c* through the terminal 33. This comparator 49*c* is constituted as an open collector type like the previous comparator 57, and the output thereof is connected to the voltage Vcc through a resistor 49*g* and also given to a reset input (R) of the above-mentioned flip-flop 49*a*. A non-inverted output (Q) of the flip-flop 49*a* is connected to the base of the switching transistor 11 (FIG. 2) through the terminal 41*a*. An inverted output ($\overline{Q}$) of the flip-flop 49*a* is connected to the base of a transistor 49*e* being connected in parallel with the capacitor 49*d*.

When a differential pulse is given from the delay circuit 47, the flip-flop 49*a* is set, and the non-inverted output (Q) thereof becomes high level. Responsively, a base current is given to the base of the switching transistor 11, and this switching transistor 11 is turned on. During the period of turn-on of this switching transistor 11, a current flows into the heating coil 9 (FIG. 2) from the rectifying circuit 3. Accordingly, a current flows through the current transformer 27, and some voltage is developed at the output of the rectifying circuit 31. The output voltage from this rectifying circuit 31 is given to the (+) terminal of the comparator 49*c* of this drive circuit 49 through the terminal 33, and when the voltage of this (+) terminal becomes smaller than the voltage of the (−) terminal, that is, the terminal voltage of the capacitor 49*d*, the voltage of low level is outputted from the comparator 49*c*. Responsively, the R-S flip-flop 49*a* is reset, and the non-inverted output (Q) thereof becomes low level and the inverted output ($\overline{Q}$) becomes high level.

When the R-S flip-flop 49*a* is reset and the inverted output ($\overline{Q}$) becomes high level, a current flows through the base of the transistor 49*e* connected to the output ($\overline{Q}$), and this transistor 49*e* is turned on. Accordingly, charges stored in the capacitor 49*d* are discharged through this transistor 49*e*, the terminal voltage of the capacitor 49*d* becomes zero, and the output of the comparator 49*d* is changed from low level to high level. Thus, in the R-S flip-flop 49*a*, the output thereof is maintained by a signal of low level. That is, a turning off state of the switching transistor 11 is sustained.

In the state where the switching transistor 11 is turned off, the collector voltage thereof is gradually reduced, becoming smaller than the integrated voltage thereof in due time. With a certain delay time set by the delay circuit 47 after the collector voltage has become smaller than the intergrated voltage thereof, as described above, a differential pulse is outputted from the delay circuit 47, and the flip-flop 49*a of the drive circuit 49 is set again. Responsively, a base drive current flows in the switching transistor 11 through the terminal 41a,* and the switching transistor 11 is turned on again. Thus, oscillatory operation of the inverter 5 is continued.

Meanwhile, in FIG. 9 embodiment, a voltage produced by the current transformer 27 and the rectifying circuit 31 is given to the terminal 33 of the drive circuit 49. However, this voltage may be a voltage produced based on a collector current Ic of the switching transistor 11.

Figure 10:
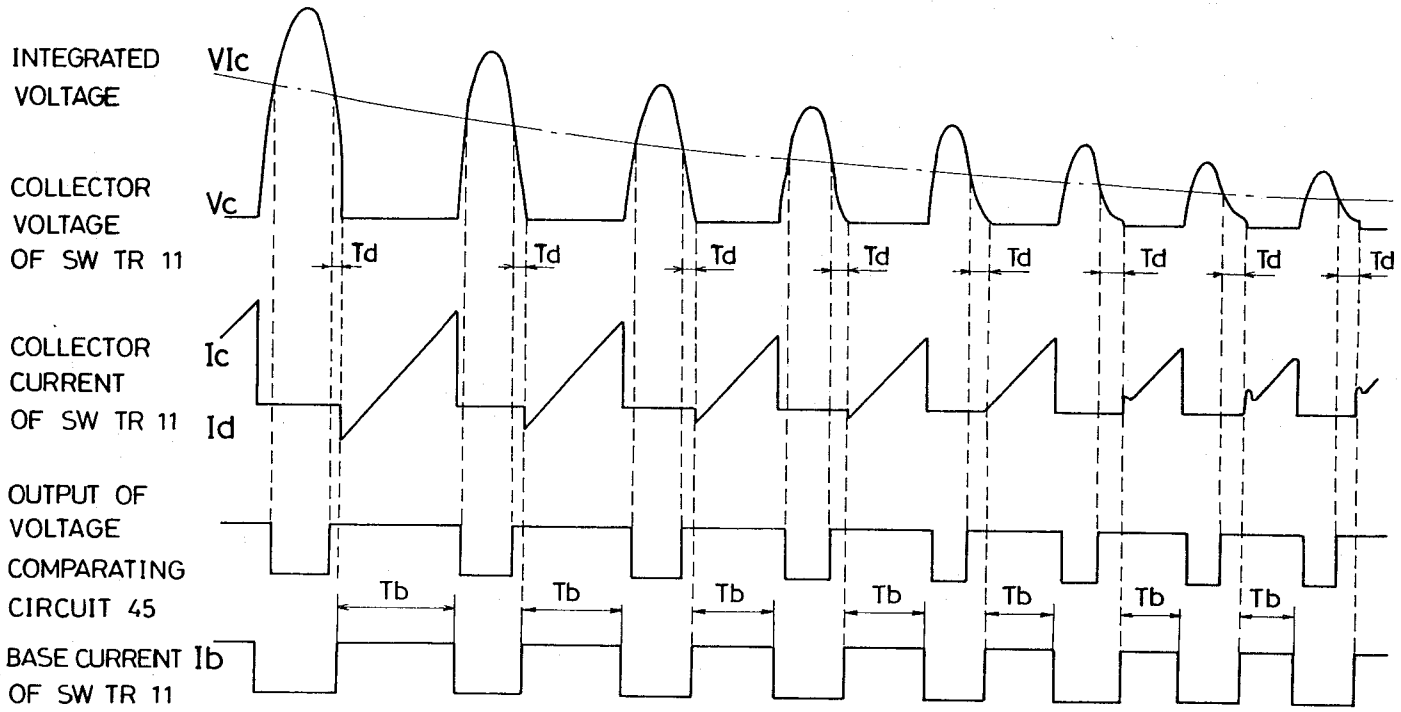
FIG. 10 is a graph of waveform at each portion for explaining operation of FIG. 2 embodiment.

Description is made on the operation of such an induction heating apparatus when the oscillation frequency is varied from low to high in reference to FIG. 10.

First, a state is supposed where the oscillation frequency of the inverter 5 is lowered by lengthening a period Tb during which a base current Ib of the switching transistor 11 flows by means of a signal from the control circuit 35. In this state, the collector current Ic of the switching transistor 11 and a diode current Id of the fly-wheel diode 15 become large, and accordingly the amplitude of a collector voltage Vc of the switching transistor 11 becomes large. When the amplitude of the collector voltage Vc is large, a rise of the collector voltage Vc becomes sharp as shown at the left side of FIG. 10, and also an integrated voltage VIc of the collector voltage Vc which is produced in the integration circuit 55 included in the control circuit 35 becomes large. In each oscillation period, when the collector voltage Vc becomes lower than the integrated voltage VIc thereof, a signal of high level is outputted from the voltage comparing circuit 45 (FIG. 3 or FIG. 4). This signal from the voltage comparing circuit 45 is delayed by a certain delay time Td by the delay circuit 47. After a lapse of this delay time Td, the flip-flop 49*a* (FIG. 9) included in the drive circuit 49 is set, and the switching transistor 11 is turned on. At this time, by appropriately selecting the delay time Td, the timing when the switching transistor 11 is turned on can be made to agree with the time when the collector voltage Vc becomes small nearly zero.

When the period Tb during which the base current Ib flows is gradually shortened and the oscillation frequency of the inverter 5 becomes high, the collector current Ic of the switching transistor 11 and the diode current Id of the flywheel diode 15 become small. Responsively, the amplitude of the collector voltage Vc of the switching transistor 11 also becomes small. In the state where the amplitude of the collector voltage Vc is small, the rise of the collector voltage Vc becomes slow as shown at the right side of FIG. 10, and a longer time than in the state of low oscillation frequency is required to bring the collector voltage Vc becomes small closely to zero again. Accordingly, as in the case with the prior art, if the comparison level is kept fixed, for example, to the DC power supply voltage, the switching transistor 11 is turned on at a earlier timing, and thereby a large inrush current flows through the switching transistor 11. However, in the present invention, since the integrated voltage VIc of the collector voltage Vc is utilized for the comparison voltage, in the state of small collector voltage Vc, the integrated voltage VIc is also small, and therefore the threshold value is also small. Consequently, the timing when the collector voltage Vc becomes lower than the integrated voltage VIc is relatively delayed in comparison with the prior art, Then, such an out put from the voltage comparing circuit 45 is delayed by the delay time Td set by the delay circuit 47, and then the switching transistor 11 is turned on. Accordingly, in accordance with the present invention, even in the state where the oscillation frequency of the inverter 5 is high, the collector voltage Vc is kept sufficiently small at the timing when supplying the base current Ib of the switching transistor 11 from the circuit 49 begins, and therefore an inrush current produced in the collector current Ic of the switching transistor 11 can be suppressed to a minimum.

Thus, in accordance with the present invention, even when the oscillation frequency is varied, the timing of beginning to supply the base current Ib to the switching transistor 11, that is, the timing of re-conduction of the switching transistor 11 agrees with an appropriate timing, that is, the timing of nearly zero of the collector voltage Vc and therefore the switching loss due to the inrush current can be suppressed to a minimum.

When the delay circuit as shown in FIG. 5 or FIG. 7 is employed, the delay time Td thereof is varied in response to the magnitude of the collector voltage Vc of the switching transistor 11. Resultingly, the delay time Td is varied in response to the resonance frequency of the heating coil 9 and the resonance capacitor 13 which is varied responding to the kind of the cooking pan. Accordingly, in the state where the collector voltage Vc is large, that is, the fall of the collector voltage Vc is sharp, the delay time Td is relatively shortened, while the amplitude of the collector voltage Vc becomes small, and the fall thereof becomes slow, and thereby the delay time Td set by the delay circuit 47 is made longer. Accordingly, the flip-flop 49*a* (FIG. 9) is set with a longer delay time after the collector voltage Vc becomes smaller than the integrated voltage VIc thereof. Thus, by varying the delay time Td set by the delay circuit 47 in response to the magnitude of the collector voltage Vc, the timing of turning on the switching transistor 11 can be made more suitable.

Figure 11:
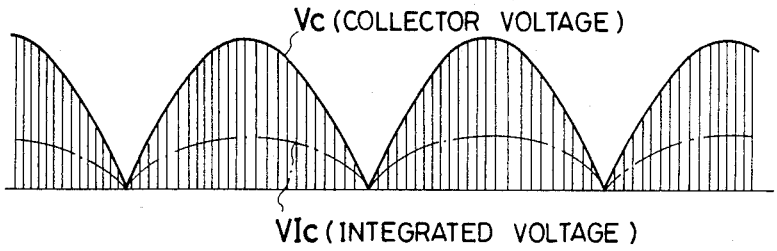
FIG. 11 is a waveform graph showing a state where the voltage across the terminals of a switching device is modulated by means of a low-frequency AC power supply.

Furthermore, as described above, since two voltages to be compared with each other are the collector voltage Vc and the integrated voltage VIc thereof, the present invention can be advantageously applied also in the case where the capacity of the input capacitor 7 is small and the collector voltage Vc is modulated by the low-frequency AC power supply 1. That is, when the collector voltage Vc is modulated by the AC voltage, the integrated voltage VIc of the collector voltage Vc is also varied in response to it as shown in FIG. 11. Consequently, a portion of near zero of the collector voltage Vc is always produced in the vicinity of the valley portion of the low-frequency AC power supply 1, and the base current Ib is applied in the vicinity of zero voltage. Also, since the integrated voltage VIc is produced from the collector voltage Vc to be used as a reference voltage, both phases agree when the voltage Vc is compared with the voltage VIc, and therefore unlike the prior art as cited previously, no trouble takes place that the oscillation of the inverter stops in the state of reduced output power, and a stable oscillatory operation can be continued within a wide range of variable output.

Although the present invention has been described and illustrated in detail, it is clearly understood that the same is by way of illustration and example only, and is not to be taken by way of limitation, the spirit and scope of the present invention being limited only by the terms of the appended claims.

What is claimed is:

1. An induction heating apparatus comprising:

a heating coil, a source of dc voltage having positive and negative voltage terminals, said positive terminal being connected to one end of said heating coil, a switching device which is connected between another end of said heating coil and said negative terminal of said source of dc voltage, for controlling a current flowing through said heating coil, a voltage sensing means for sensing a voltage across terminals of said switching device, an integrating means for integrating said voltage across said terminals of said switching device sensed by said voltage sensing means, a comparing means for comparing said voltage across said terminals of said switching device with said integrated voltage, and a control means for controlling said switching device based on an output of said comparing means.

2. An induction heating apparatus in accordance with claim 1, further comprising a delay means which is inserted between said comparing means and said control means and delays the output of said comparing means so as to control said switching device with a certain delay time after the output of said comparing means is given.

3. An induction heating apparatus in accordance with claim 2, further comprising a time varying means for varying the delay time set by said delay means in response to the magnitude of said voltage across terminals of said switching device.

4. An induction heating apparatus in accordance with claim 3, wherein said delay means includes a charge storing means, and said time varying means includes a means for varying the quantity of charges of said charge storing means in response to said voltage across terminals of said switching device.

5. An induction heating apparatus comprising:

an inverter including a heating coil, a power source, and a switching device connected in series, whereby said switching device controls a current flowing through said heating coil, first means for providing a first comparison voltage corresponding to the voltage across said switching device, second means for providing a second comparison voltage corresponding to the integral of the voltage across said switching device, a comparing means for comparing said first and second comparison voltages, a control means for controlling said switching device in response to an output of said comparing means, a delay means which is inserted between said comparing means and said control means, for delaying the output of said comparing means, and a time varying means for varying the delay time set by said delay means in response to the magnitude of one of said first and second comparison voltages.

6. An induction heating apparatus in accordance with claim 5, wherein said delay means includes a charge storing means, and said time varying means includes a means for varying the quantity of charges of said charge storing means in response to the voltage across terminals of said switching device.

* * * * *